US011953305B2

(12) United States Patent
Kruger

(10) Patent No.: US 11,953,305 B2
(45) Date of Patent: Apr. 9, 2024

(54) DETONATOR INSTALLATION INCLUDING A CONTROLLER

(71) Applicant: DETNET SOUTH AFRICA (PTY) LTD, Johannesburg (ZA)

(72) Inventor: Michiel Jacobus Kruger, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 327 days.

(21) Appl. No.: 17/426,321

(22) PCT Filed: Jan. 23, 2020

(86) PCT No.: PCT/ZA2020/050004
§ 371 (c)(1),
(2) Date: Jul. 28, 2021

(87) PCT Pub. No.: WO2020/163883
PCT Pub. Date: Aug. 13, 2020

(65) Prior Publication Data

US 2022/0099421 A1 Mar. 31, 2022

(30) Foreign Application Priority Data

Feb. 4, 2019 (ZA) ..... 2019/00727

(51) Int. Cl.
*F42C 11/00* (2006.01)
*F42D 1/045* (2006.01)

(52) U.S. Cl.
CPC ..... *F42C 11/008* (2013.01); *F42D 1/045* (2013.01)

(58) Field of Classification Search
CPC ..... F42C 11/008; F42D 1/045; F42D 1/05; F42D 1/055
See application file for complete search history.

(56) References Cited

U.S. PATENT DOCUMENTS 3,395,686 A * 8/1968 Minks ..... F02P 3/0884 327/191
4,769,734 A * 9/1988 Heinemeyer ..... F42C 15/40 361/91.1
4,967,665 A * 11/1990 Baginski ..... F42B 3/185 102/206
8,161,877 B1 4/2012 Frickey et al.
2006/0249045 A1 11/2006 Goodman et al.
2007/0125256 A1* 6/2007 Frickey ..... F42D 1/045 102/205

FOREIGN PATENT DOCUMENTS

EP 1529696 B1 12/2011

OTHER PUBLICATIONS

International Search Report for PCT/ZA2020/050004, international filing date of Jan. 23, 2020, dated May 18, 2020, 4 pages.
Written Opinion for PCT/ZA2020/050004, international filing date of Jan. 23, 2020, dated May 18, 2020, 5 pages.

* cited by examiner

*Primary Examiner* — Bret Hayes
(74) *Attorney, Agent, or Firm* — CANTOR COLBURN LLP

(57) ABSTRACT

A detonator installation (10) in which a detonator fire capacitor (36) which is connected in series with an inductor (18) is charged from a low voltage source (16) by repeatedly opening and closing a switch (20) thereby to cause a collapsing magnetic field in the inductor (18) which results in a charging current flow to the capacitor (36).

3 Claims, 1 Drawing Sheet

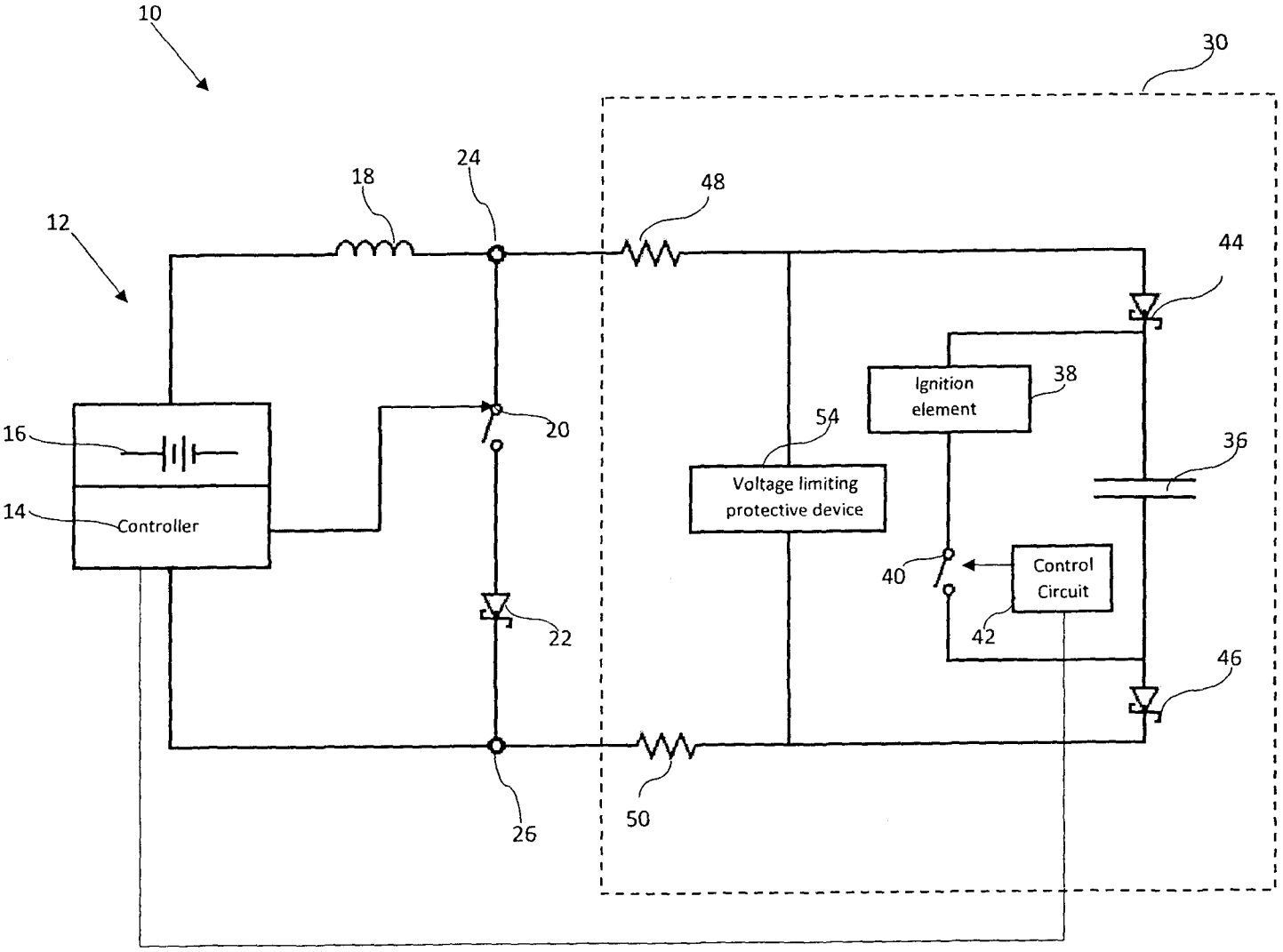
10
12
14
16
18
20
22
24
26
30
36
38
40
42
44
46
48
50
54
Controller
Ignition element
Control Circuit
Voltage limiting protective device

DETONATOR INSTALLATION INCLUDING A CONTROLLER

CROSS-REFERENCE TO RELATED APPLICATIONS

This application is a U.S. national stage application of International Application No. PCT/ZA2020/050004 entitled "BOOST PUMP", which has an international filing date of 23 Jan. 2020, and which claims priority to South African Patent Application No. 2019/00727, filed 4 Feb. 2019.

BACKGROUND OF THE INVENTION

This invention relates to a detonator installation which includes control equipment and an electronic detonator.

An electronic detonator includes an ignition element and a fire capacitor. The fire capacitor is, in use, charged to a particular voltage and the energy stored in the capacitor is discharged in the ignition element, when required, in order to fire the detonator.

Electrical energy is supplied to the installation from an electrical energy source. Due to current leakage, resistance and other effects, energy losses occur which in practice give rise to physical limitations. For example if the electrical losses are such that the voltage available to charge a capacitor is too low then the arrangement is not functional.

An object of the present invention is to address, at least to some extent, this aspect.

SUMMARY OF INVENTION

The invention provides a detonator installation which includes control equipment comprising a controller, a voltage source, an inductor and a switch which are connected in series with the voltage source, and output terminals, and at least one detonator which includes a capacitor and at least one protective diode, connected in series to the output terminals, wherein the controller is operable repeatedly to close the switch thereby to direct current from the voltage source through the inductor which then establishes a magnetic field, and to open the switch so that the magnetic field collapses and generates a current which flows via the output terminals through the capacitor and the diode thereby to charge the capacitor.

The inductor is preferably physically removable from the control equipment. The inductor can thus be used as a key in that, once the inductor is correctly installed, the installation is operable but if the inductor is absent the installation is not operable. This aspect is, however, optional.

BRIEF DESCRIPTION OF THE DRAWING

The invention is further described by way of example with reference to the accompanying drawing which depicts aspects of a detonator installation according to the invention.

DESCRIPTION OF PREFERRED EMBODIMENT

The accompanying drawing is a schematic illustration of a detonator installation 10 according to the invention.

The detonator installation 10 includes control equipment 12 which comprises a controller 14 and a voltage source or battery 16.

An inductor 18, a switch 20 and a protective diode 22 are connected in series to output terminals 24 and 26 of the control equipment 12.

The switch 20 is of any appropriate type e.g. an electronic switch. The controller 14 is operable to cause repeated closure and opening of the switch 20 in a regulated manner.

The controller 14 may be microprocessor-based.

The installation 10 also includes a detonator 30 which is not shown in detail. A full explanation of the workings of the detonator 30 is not necessary for an understanding of the present invention. The detonator 30 includes a fire capacitor 36 which is connected in parallel to an ignition element 38 and a switch 40 which is under the control of a control circuit 42. Protective diodes 44 and 46, and resistors 48 and 50, are in series with the capacitor 36. The diodes 44, 46 are bridged by a voltage limiting, protective device 54 e.g. a Zener diode. The controller 14 may be microprocessor-based.

In order to charge the capacitor 36 the controller 14 is operated repeatedly to close the switch 20 and then to open the switch. When the switch 20 is closed current from the voltage source 16 is directed through the inductor 18 and a magnetic field is established by the inductor. When the switch 20 is opened the current flow is stopped and the magnetic field collapses. Current of a high value is induced by the change in the magnetic field and this current flows, via the resistors 48 and 50 and the diodes 44 and 46, and charges the capacitor 36.

With each cycle of operation of the switch 20 i.e. closure and opening thereof, an electrical charge is imparted to the capacitor 36. The voltage across the capacitor thus builds up in bursts. To prevent the capacitor 36 from being overcharged in this way the device 54 "breaks down" at a predetermined voltage and, as it is in parallel with the capacitor 36, the device 54 prevents current from flowing through the capacitor 36.

The described arrangement makes it possible for the capacitor 36 to be charged in a safe and effective manner from the voltage source 16 which has a relatively low voltage compared to the comparatively high voltage which is established over the capacitor 36 when it is correctly charged. When the ignition element 38 is to be fired this is effected by means of the switch 40 which functions under the control of the circuit 42.

The low voltage required to charge the capacitor 36 means that the control equipment 12 can be made intrinsically safe i.e. it does not have a voltage on-board which is of a high enough value to fire the detonator 30. It is not possible to charge the capacitor 36 unless at least one of the diodes 44 and 46 is present. A particular safety feature is that the inductive coil 18 can be used as a key to enable the detonator installation to become operative. If the coil 18 is physically removed (disconnected) from the control equipment 12 then charging of the capacitor 36 is not possible. This is a useful safety feature.

The use of the device 54 is optional for inclusion of the device is not necessary for the voltage boosting process to be achieved. Also, it is possible to position the device 54 directly across the terminals 22 and 24 in order to limit the current that can be delivered to the detonator 30.

The voltage boost process, carried out in the described manner, means that the energy leakage problem referred to in the preamble hereof is addressed. As noted in a typical circuit if voltage starvation is pronounced the likelihood increases that the available voltage, at the end of an extended line of detonators, might be insufficient to charge the fire capacitor. The technique described herein allows for substantial energy leakage to take place while still maintaining the capability to charge the fire capacitor successfully.

The invention claimed is:

1. A detonator installation including control equipment, the control equipment comprising:

a controller;

a voltage source, an inductor and a switch connected in series with the voltage source;

output terminals; and at least one detonator including a capacitor and at least one protective diode, the capacitor and the at least one protective diode being connected in series to the output terminals;

wherein the controller is operable repeatedly to close the switch, thereby to direct current from the voltage source through the inductor which then establishes a magnetic field, and to open the switch so that the magnetic field collapses and generates a current which flows via the output terminals through the capacitor and the diode thereby to charge the capacitor.

2. A detonator installation according to claim 1 wherein the inductor is physically removable from the control equipment.

3. A detonator installation according to claim 1 including a voltage limiting protective device connected in parallel to the detonator, or in parallel to the output terminals.

* * * * *